US006855902B2

(12) United States Patent
Lee et al.

(10) Patent No.: US 6,855,902 B2
(45) Date of Patent: Feb. 15, 2005

(54) SELF BOUNCING ARC SWITCH

(75) Inventors: Kwang Won Lee, Taejon-si (KR); Seung Ho Jeong, Taejon-si (KR); Young Dug Bae, Taejon-si (KR)

(73) Assignee: Korea Atomic Energy Research Insitute, Taejon-si (KR)

( * ) Notice: Subject to any disclaimer, the term of this patent is extended or adjusted under 35 U.S.C. 154(b) by 0 days.

(21) Appl. No.: 10/478,653

(22) PCT Filed: Jun. 29, 2001

(86) PCT No.: PCT/KR01/01123

§ 371 (c)(1),
(2), (4) Date: Nov. 25, 2003

(87) PCT Pub. No.: WO03/005392

PCT Pub. Date: Jan. 16, 2003

(65) Prior Publication Data

US 2004/0179317 A1 Sep. 16, 2004

(51) Int. Cl.[7] ..... H01H 33/70
(52) U.S. Cl. ..... 218/56; 361/120
(58) Field of Search ..... 218/56, 90, 43, 218/46, 22, 23, 29; 361/115–117, 120, 121, 123; 335/201, 202, 147, 195, 16

(56) References Cited

U.S. PATENT DOCUMENTS 3,947,649 A * 3/1976 Hertz ..... 218/22
4,553,008 A * 11/1985 Veverka et al. ..... 218/56
4,560,848 A * 12/1985 Arimoto ..... 218/23
5,750,949 A * 5/1998 Rees et al. ..... 218/43
5,854,732 A 12/1998 Murray
5,877,464 A 3/1999 Moldovan

FOREIGN PATENT DOCUMENTS

JP 10-0308542 8/2001

OTHER PUBLICATIONS

An article entitled Ultra–High–Power Plasma Switch INPIS for. . ., By Lee, published NASA Langley Research Center, pp. 412–417.

* cited by examiner

*Primary Examiner*—Lincoln Donovan
*Assistant Examiner*—M. Fishman
(74) *Attorney, Agent, or Firm*—Bachman & LaPointe, P.C.

(57) ABSTRACT

The invention concerns a high coulomb transfer switch useful for high current pulse supplies, employing a self-bouncing arc mechanism, wherein two cylindrical electrodes are coaxially arranged and the pathway of current inside the switch is specially designed such that arc current sheet positioned between the coaxially arranged electrodes makes a self bouncing movement in an axial and/or circumferential direction. The self-bouncing arc switch according to the present invention makes it possible to maximize the working area of the electrodes, thereby spread arc energy effectively over the electrodes.

4 Claims, 3 Drawing Sheets

SELF BOUNCING ARC SWITCH

FIELD OF THE INVENTION

The present invention relates generally to arc switches required in the generation of high current pulses from a capacitor bank and more particularly to a self bouncing arc switch, which can be used as a high current pulse switch. Fields of application range from industrial uses to a variety of technologies such as electro-thermal blaster, De-NOx/De-SOx systems, particle accelerators, welders with large capacities, high power pulse lasers, electric furnaces, plasma generators, light source systems, electro-thermal guns, radar systems, and high power microwave amplifiers.

BACKGROUND

Generally, arc gap switches or spark gap switches are used as switches for high voltage, high current pulses, which typical semiconductor switches have trouble enduring. These switches should ensure controllability while withstanding voltages of several tens of kilovolts and should have regular operating characteristics under varying ambient operating conditions. Especially, since high current pulses passing through the switches have high temperature arcs, which create temperatures of tens of thousands of degrees Celsius such as that present in a bolt of lightning, the switches should have an operational principle and structure being made of special materials such that electrode damage can be prevented. Additionally, the size, durability, maintenance, and cost of the switches must be taken into account.

Meanwhile, conventional switches for handling high current pulses employ various principles and methods. Such high current switches include, among others, an ignitron type, an inverse pinch type, a pseudo spark gap type, a triggered vacuum type, and a rotary arc type. Although the above switch types exhibit different characteristics and each have their own advantages and disadvantages, none of the conventional switches satisfy all of the above-mentioned requirements.

The conventional switches are especially problematic in terms of a limited lifetime over which controllability and stable operating characteristics can be ensured, which in turn limits utility. These problems are mainly caused by a deterioration of the operating characteristics or a functional loss of the switches, due to electrode burnout or insulation breakdown, which results in the catastrophic failure of the switch.

SUMMARY OF THE INVENTION

Accordingly, the present invention has been made with the above problems in mind.

It is an object of the present invention to provide a self bouncing arc switch, which can extend the operational lifetime of a switch used for high voltage, high current applications and can ensure controllability and stable operating characteristics of the switch by minimizing the occurrence of localized burnout of electrodes, leakage current at the surface of an insulator, and insulator breakdown, even under conditions of high current flow and high charge transfer capacity.

DESCRIPTION OF REFERENCE NUMERALS

Figure 1:
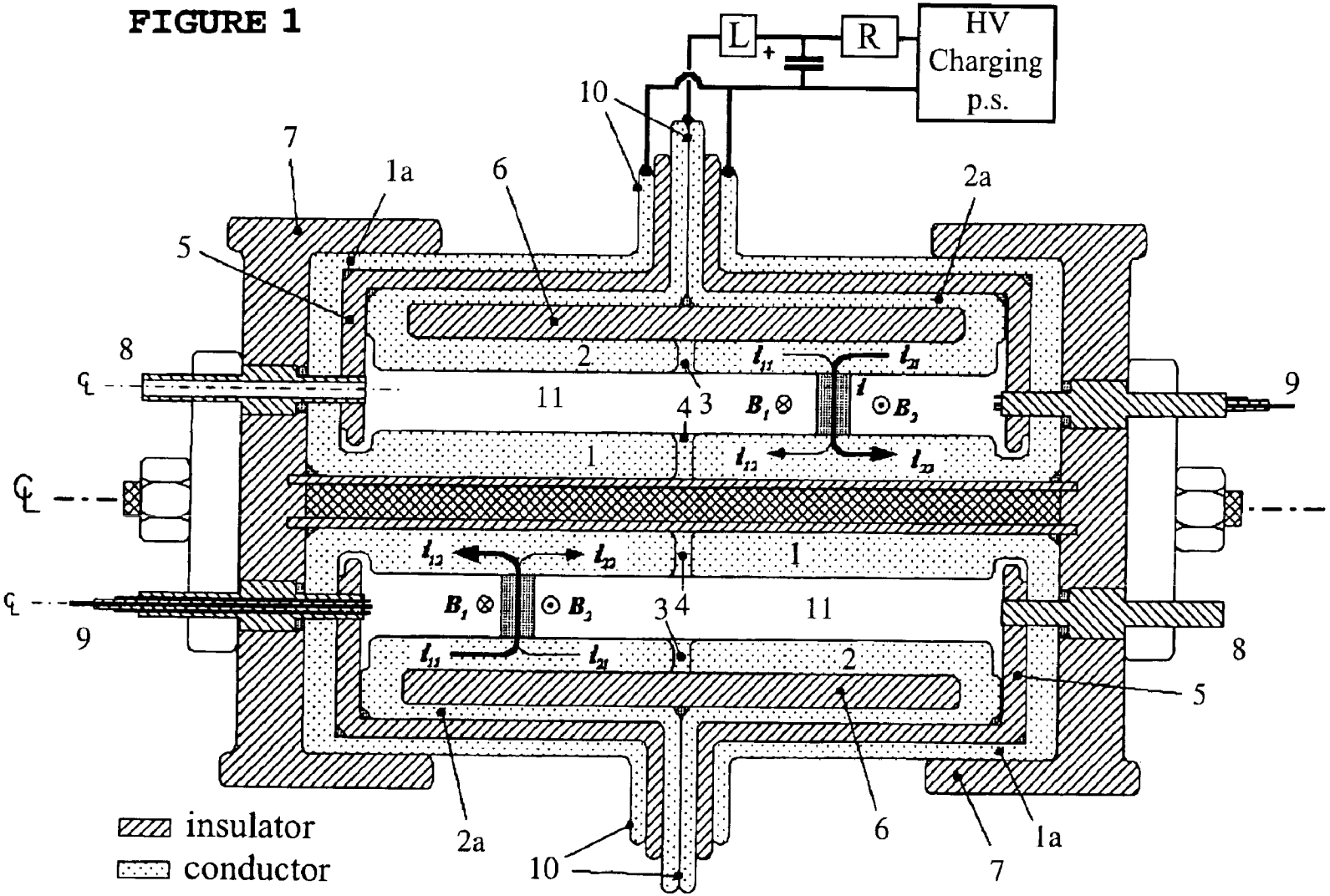
FIG. 1 is a sectional view showing the schematic construction of a switch for high current conduction using an arc which performs a self-bouncing movement between coaxial electrodes, according to a preferred embodiment of the present invention.

1: inner electrode, cylindrically formed and axially arranged; 1*a*: outer conductor

2: outer electrode, cylindrically formed and axially arranged; 2*a*: inner conductor

3: first gap, centrally positioned along the outer electrode

4: second gap, centrally positioned along the inner electrode

5: first insulation layer, interposed between the inner and outer conductors

6: second insulation layer, separating axial current paths of the outer electrode

7: insulating structure, covering the ends of coaxial switch structure

8: arc working gas ports

9: trigger electrodes, inducing an arc at the ends of the inner electrode

10: terminals

11: spacing unit

DETAILED DESCRIPTION OF THE PREFERRED EMBODIMENTS

In order to accomplish the above object, the present invention provides a self bouncing arc switch, which operates using a structure and principle whereby two cylindrical electrodes of differing diameters are coaxially arranged and a switching arc between the coaxial electrodes, which is started by a trigger electrode located at either end of the switch, is made to "self-bounce" axially or circumferentially (i.e. along the axis or about the axis) by adjusting current paths, thus maximizing the working area of electrodes to uniformly spread arc energy over the electrodes and preventing the arc from approaching insulators.

Consequently, the present invention reduces the occurrence of electrode burnout, leakage current, and insulation breakdown under conditions of high current flow and high charge transfer capacity, thus extending the switch's operational lifetime over which performance and reliability of the switch are ensured. In contrast to conventional spark gap switches, the switching capacity of the self bouncing arc switch of the present invention can be limitlessly increased by simply increasing its physical dimensions.

Meanwhile, an inverse pinch switch and a rotary arc switch are switches utilizing a wide electrode area.

The inverse pinch switch, however, exhibits increased jitter time with the simultaneous use of plural trigger electrodes. The self bouncing arc switch of the present invention, on the other hand, solves this problem through the utilization of single point triggering.

The rotary arc switch is problematic in three areas: (1) a noise component is revealed in a current waveform when an arc spans a gap while rotating along the circumference of the switch; (2) circuit design is restricted by limitations in the reduction of inductance because the current terminals are arranged on opposite sites of a circumference; (3) the working area of electrode is restricted within the narrow circumferential band. On the other hand, the self bouncing arc switch of the present invention can eliminate the need for gaps, enables the current terminals to be positioned in close proximity to each other, and allows for the electrodes to extend axially, thus realizing low noise, low inductance, and large working area of the electrodes.

For switches whose switching arc movements are performed without a self-bouncing operation, that is, single arc movement for the duration of a discharge cycle, electrode length or diameter must be increased to accommodate increased amperage or longer discharge times. The self-bouncing operation of the arc switch of the present invention can reduce the size of each electrode because the bouncing movement of an arc is performed repeatedly until electric discharge is completed.

The above object and other advantages of the present invention will be more clearly understood from the following detailed description taken in conjunction with the accompanying drawings by those skilled in the field.

Hereinafter, a preferred embodiment of the present invention is described in detail with reference to the accompanying drawings.

FIG. 1 is a sectional view of a self bouncing arc switch embodied according to the present invention.

As shown in FIG. 1, the self bouncing arc switch of the present invention comprises an inner electrode 1, an outer electrode 2, arc working gas ports 8, one or more trigger electrodes 9, an inner conductor 2*a* for conducting current, an outer conductor 1*a* for conducting current, and terminals 10. The inner electrode 1 is fitted around a central shaft and cylindrically disposed around the central shaft. The outer electrode 2 is arranged to be concentric with the inner electrode 1 while being spaced apart from the outer surface of the inner electrode 1 to form a spacing unit 11. The arc working gas ports 8 serve to inject arc working gas into the spacing unit 11 and fill the space between the inner and outer electrodes 1 and 2, such that a switching arc makes electrical contact between the inner and outer electrodes axially and circumferentially, and serve to evacuate injected arc working gas. The trigger electrodes 9 are each disposed between one end of the inner electrode 1 and one end of the outer electrode 2 to breakdown the arc working gas and initiate the switching arc. The inner conductor 2*a* is arranged to be spaced apart from the outer circumference of the outer electrode 2 and extends outwardly from each end of the outer electrode 2. The outer conductor 1*a* extends outwardly from each end of the inner electrode 1, such that the outer surface of the inner conductor 2*a* is covered with a first insulation layer 5 interposed between the inner and outer conductors. The terminals 10 are leaded at the ends of the inner conductor 2*a* and the outer conductor 1*a*, respectively, to connect the conductors to external circuitry and loads.

In detail, the self bouncing arc switch of the present invention works on the basis of the following construction and principle. The ends of the inner electrode 1 and the outer electrode 2 are each extended by disc conductors. Two pairs of disc conductors, i.e., left and right disc conductors for each electrode, connect the two concentric conductors 1*a* and 2*a*, which extend as flanges outwardly from their respective electrodes, to the electrodes 1 and 2 at the same polarities. The conductors 1*a* and 2*a*, which are also cylindrical, are each symmetrically arranged lengthwise about the center of each conductor. The terminals 10 are provided for inputting and outputting current. The current pathway conductors 1*a* and 2*a* are isolated from each other by the first insulation layer 5. The trigger electrodes 9 and the arc working gas ports 8 are respectively provided at both axial ends of the switch. Then, the switching arc starts at one axial end using any one trigger electrode 9, such that a current to be switched adjusts its path, without external means, thus enabling the switching arc between coaxial electrodes to perform a self-bouncing movement axially or circumferentially. Therefore, the working area of the electrodes is maximized, thereby allowing arc energy to be uniformly spread over the electrodes of the switch and preventing the arc from approaching the insulators.

The terminals 10 protrude from the outer surfaces of the center portions of the respective inner and outer conductors 2*a* and 1*a*, with the first insulation layer 5 interposed between the inner and outer conductors. Alternatively, one or more coaxial cables can be provided, to allow the outer and inner conductors of the cable to be connected to the inner and outer conductors 2*a* and 1*a*, respectively.

Figure 3:
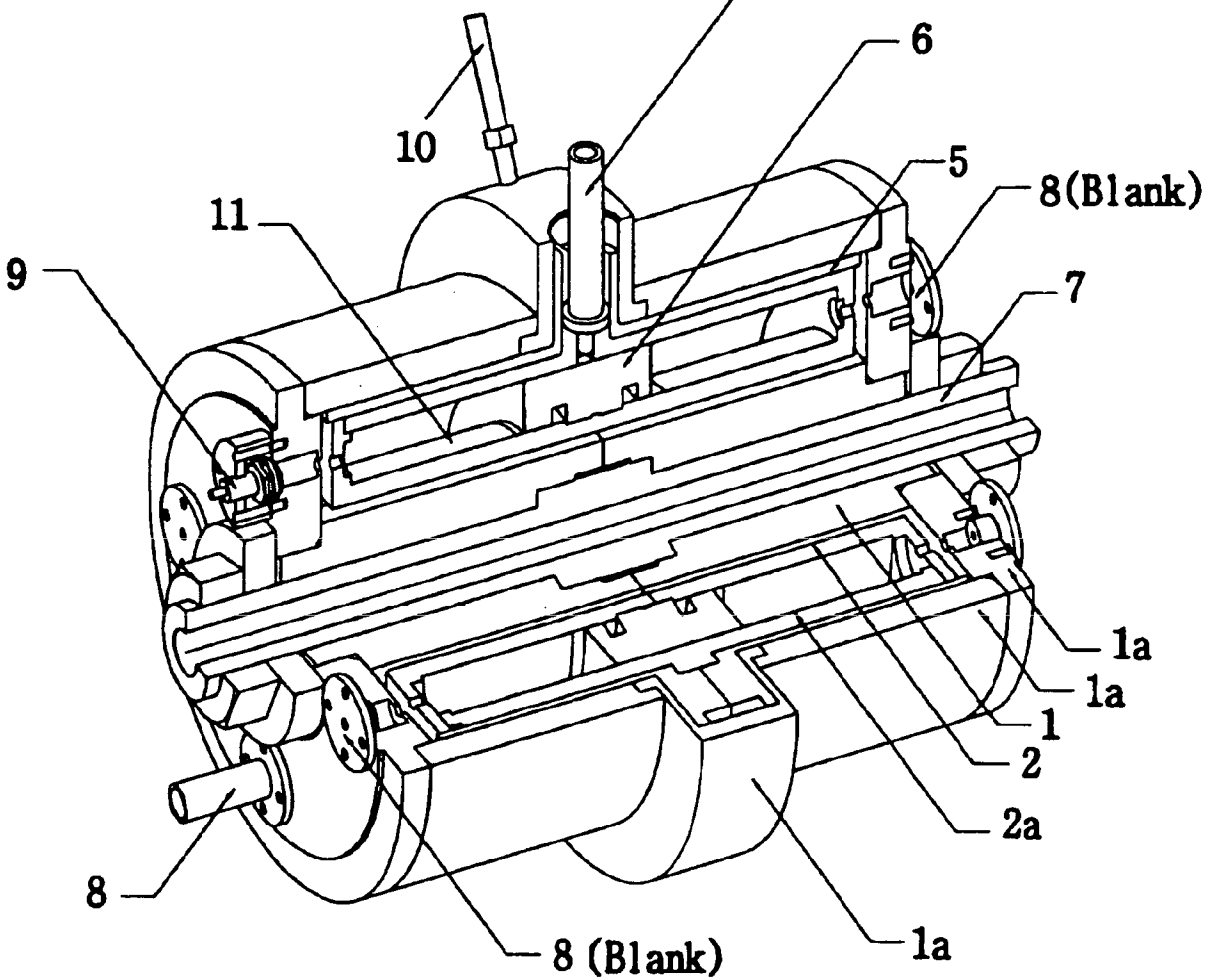
FIG. 3 is a perspective view showing an example of the connection of a terminal of the switch of FIG. 1 to a coaxial cable.

For example, as shown in FIG. 3, if the switch has a single terminal of a coaxial cable structure, the shape of the switch of the present invention resembles a hammer with a cylindrical head, and the terminal of coaxial cable structure corresponds to the handle of the hammer. If the switch has multiple terminals of coaxial cable structure, the terminals are preferably arranged on the circumference of the cylinder of the switch at regular intervals to be axially symmetrical.

If increased bouncing force is required when the arc reaches the ends of the electrodes, first and second gaps 3 and 4 can be introduced, thus dividing the respective electrodes midway axially. Alternatively, the thickness of a second insulation layer 6 may be increased. The second insulation layer 6 is provided between the outer electrode 2 and the inner conductor 2*a*. On the other hand, the dimensions of the first and second gaps 3 and 4 and the second insulation layer 6, that is, the formation of the inner conductor 2*a*, are all adjusted simultaneously (or any one is adjusted) such that when the arc approaches the axial ends, the bouncing force applied to the arc is adjusted or the period of repeated bouncing movement along the axis is adjusted.

It is preferable to fundamentally design the components of the switch to be symmetrical bilaterally, regardless of the existance of the first and second gaps 3 and 4 between the left and right portions of the outer electrode 2 and between the left and right portions of the inner electrode 1, respectively, to facilitate the assembly and manufacture of the switch.

One or more trigger electrodes 9 are inserted between the electrodes 1 and 2 such that the arc starts from one of the axial ends of the switch. In this case, two trigger electrodes 9 are respectively installed in the left and right ends of the switch, in anticipation of electrode burnout occurring asymmetrically. If the two trigger electrodes 9 can be alternately operated after a predetermined number of switching operations are performed, the life of the switch is effectively extended.

If several trigger electrodes 9 are introduced, the trigger electrodes 9 are positioned radially such that the trigger electrodes 9 are to be axially symmetrical in the disc structure at both axial ends of the switch. The trigger electrodes 9 are to be high-voltage insulated from the conductors 1*a* and 2*a*.

The number of trigger electrodes 9 is not specially limited, and any one trigger electrode is only used for a single switching operation.

The arc working gas ports 8 are disposed at both axial ends of the switch between the electrodes 1 and 2. If high pressure is generated in the switch by the switching arc, a safe container of appropriate volume for absorbing impacts is connected to one of the arc working gas ports 8, to prevent damage to the switch due to the impact of the pressure.

Portions of the electrodes, conductors, and insulators and the inserted portions of the trigger electrodes 9 and the working gas ports 8 are constructed to be shielded with means such as a gasket or metal-to-ceramic brazing, such that the arc working gas in the switch is isolated from the air. The arc working gas may be, for example, nitrogen or heavy hydrogen. The spacing unit 11 may also be a vacuum.

Hereinafter, the operation of the self bouncing arc switch having the above construction is described in detail.

If discharge is started at one end in the switch by the trigger electrodes 9, current flowing through the outer electrode 2 and the inner electrode 1, each of which are themselves conductors of current, is concentrated along a current path of discharge starting side. For example, if the discharge starts at the right end of the switch shown in FIG. 1, a discharging current i ($i_{11}+i_{21}$ or $i_{12}+i_{22}$) is divided such that $i_{21}+i_{22}$ is greater than $i_{11}+i_{12}$. Therefore, magnetic fields are generated by the discharging current such that $B_1$ is less than $B_2$, so an arc current pillar is applied with force to move to the left.

For convenience of understanding, provided that the current i is constant during a discharging period, the force is the largest in the right end of the electrode, becomes decreased as the arc current pillar moves to the left, and disappears around the center portion of the left-right symmetrical electrode. Thereafter, the arc current pillar continuously moves to the left portion over the center portion of the electrode due to the momentum obtained while proceeding to the right portion of the left-right symmetrical electrode, and the discharging current i is divided such that $i_{21}+i_{22}$ is less than $i_{11}+i_{12}$, so $B_1$ is greater than $B_2$. Therefore, a force whose direction is opposite to, and whose intensity is left-right symmetrical to, that of the right portion, acts on the arc current pillar. Consequently, a left-right symmetrical potential well is formed in along the central axis of the switch, so the arc current pillar performs bouncing movement to be alternately bounced at both ends of the switch for the duration of the discharging time.

Even if the discharging current i varies temporarily, the basic principle of such a bouncing movement is valid although the variation of amplitude is not linear. During the bouncing movement of the arc current pillar, the intensity of force at any one position is a function of the distance between the electrodes 1 and 2, the thickness of the first insulation layer 5, the thickness of each of the electrodes 1 and 2 and the conductors, the dimension of the second insulation layer 6 surrounded by the outer electrode 2 and the left-right symmetrical current path thereof, and the existence and the size of the first and second gaps 3 and 4 as well as a function of current i.

Figure 2:
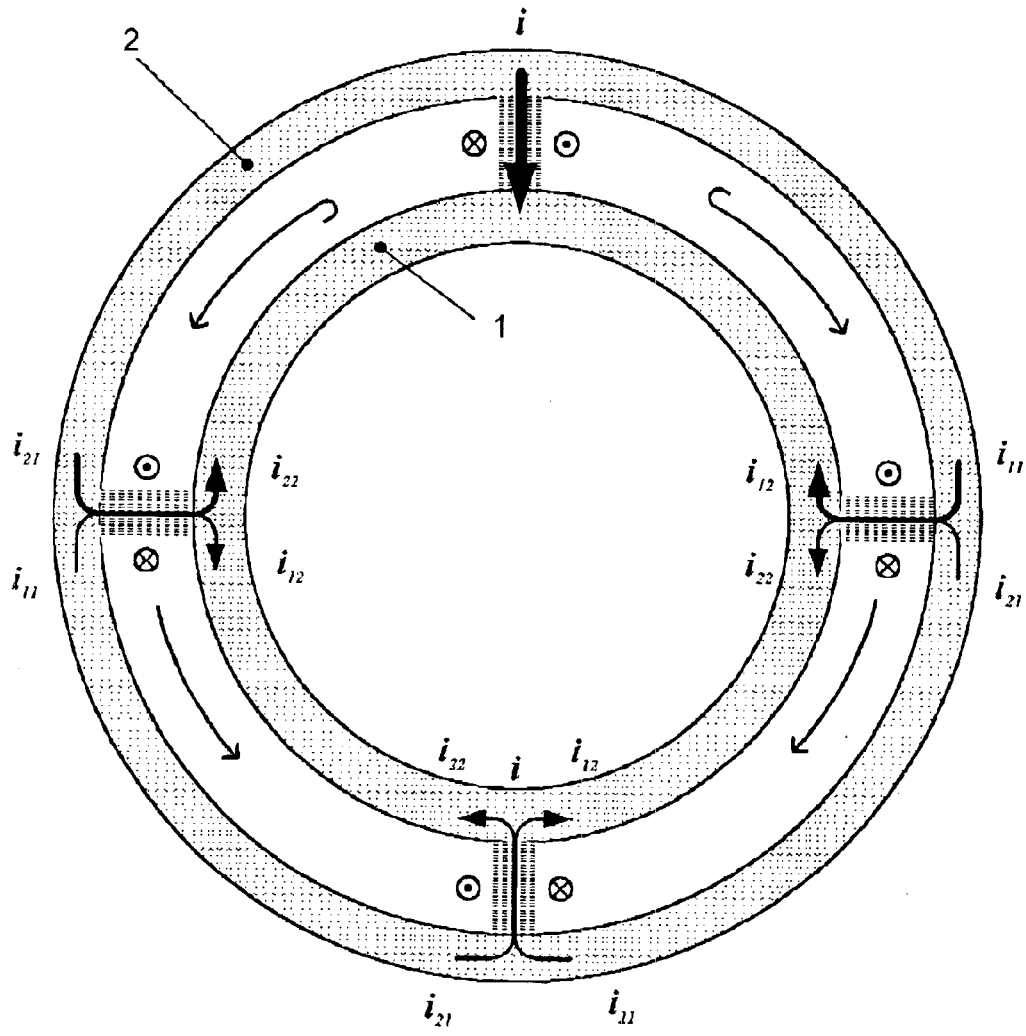
FIG. 2 is a conceptual view showing the principle of a self-bouncing movement of an arc, which transfers current in a cross section and moves like a pendulum.

Meanwhile, if the arc does not start uniformly circumferentially by a single point trigger method, the arc current pillar starts to move circumferentially by the well-known kink instability. As shown in FIG. 2, the started circumferential movement of the arc continues the bouncing movement like a pendulum action along the circumference between two electrodes for the duration of the discharge, by the same principle as the linear bouncing movement along the axis described above. Even without spontaneous kink instability, the same effect as the above case can be obtained if the trigger position and the current inlet/outlet position of the switch are offset from each other at a predetermined angle on the circumference. The ratio of the circumferential oscillation period to the axial oscillation period depends on the shape of the switch, the size of the electrodes, the intensity of the current, and the distance between current paths.

INDUSTRIAL APPLICABILITY

As described above, the present invention provides a self bouncing arc switch, which can be widely utilized as a durable switch, ensuring controllability and reliability in various equipment and fields requiring high current pulses, ranging from industrial uses to a variety of technologies such as electro-thermal blaster, De-NOx and/or De-SOx systems, particle accelerators, welders with large capacities, high power pulse lasers, electric furnaces, plasma generators, light source systems, electro-thermal guns, radar systems, and high power microwave amplifiers. The self bouncing arc switch of the present invention can also replace expensive high-power semiconductor switching systems.

The self bouncing arc switch of the present invention exhibits stable switching operation over a longer life compared with that of a conventional arc switch. Thus, with the provision of an appropriate cooling means for electrodes and other conductors, the self bouncing arc switch of the present invention can be applied as a heavy duty switch in, for example, circuits where a high current crowbar or free-wheeling operation is frequently required.

What is claimed is:

1. A self bouncing arc switch, comprising:

an inner electrode (1), having two ends, fitted around a central shaft and cylindrically disposed around the central shaft;

an outer electrode (2), having two ends, arranged to be concentric with said inner electrode and spaced apart from an outer surface of said inner electrode, to form a spacing unit (11) between said inner and outer electrodes;

one or more arc working gas ports (8) for injecting arc working gas into the spacing unit, such that a switching arc makes electrical contact between said inner and outer electrodes axially or circumferentially, and for evacuating injected arc working gas;

one or more trigger electrodes (9) each disposed between one end of said inner electrode and one end of said outer electrode, to breakdown the arc working gas and initiate the switching arc;

an inner conductor (2*a*), extending outwardly from both ends of said outer electrode, arranged to be spaced apart from an outer surface of said outer electrode;

an outer conductor (1*a*), extending outwardly from both ends of said inner electrode to cover the outer surface of said inner conductor with a first insulation layer (5) interposed between said inner and outer conductors; and one or more terminals (10), leaded at each end of said inner and outer conductors, for connecting said inner and outer conductors to external circuitry.

2. The self bouncing arc switch according to claim 1, further comprising:

a second insulation layer (6) formed between said outer electrode and said inner conductor, wherein first and second gaps (3) and (4) are formed in axial center portions of said outer electrode and said inner electrode, respectively, and wherein either the period of an axial bouncing movement or a bouncing force applied to the arc when the arc approaches axial ends of the switch, is adjustable with the thickness of the second insulation layer and the size of the first and second gaps.

3. The self bouncing arc switch according to claim 1 or 2, wherein said one or more terminals protrude from the outer surface in center portions of said inner and outer conductors or wherein said one or more terminals are formed such that one or more coaxial cables are provided to allow the inner and outer insulated conducting wires to be connected to said inner and outer conductors, respectively.

4. The self bouncing arc switch according to claim 1 or 2, wherein an integration of said inner electrode with said outer conductor, an integration of said outer electrode with the inner conductor, and the first insulation layer are each constructed to be left-right symmetrical lengthwise along an axis of the switch.

* * * * *